US007394427B2

(12) United States Patent
Cho et al.

(10) Patent No.: US 7,394,427 B2
(45) Date of Patent: Jul. 1, 2008

(54) MULTILAYER PLANAR ARRAY ANTENNA

(75) Inventors: Tae-Kwan Cho, Suwon-si (KR); Young-Sup Bang, Suwon-si (KR)

(73) Assignee: Motonix Co., Ltd., Hwaseong-si (KR)

( * ) Notice: Subject to any disclaimer, the term of this patent is extended or adjusted under 35 U.S.C. 154(b) by 0 days.

(21) Appl. No.: 11/514,762

(22) Filed: Sep. 1, 2006

(65) Prior Publication Data

US 2007/0200764 A1 Aug. 30, 2007

(30) Foreign Application Priority Data

Feb. 24, 2006 (KR) ..... 10-2006-0018151

(51) Int. Cl.
*H01Q 1/38* (2006.01)

(52) U.S. Cl. ..... 343/700 MS; 343/853; 343/776

(58) Field of Classification Search ..... 343/700 MS, 343/853, 772, 776, 771
See application file for complete search history.

(56) References Cited

U.S. PATENT DOCUMENTS 6,297,774 B1 * 10/2001 Chung ..... 343/700 R
7,075,494 B2 * 7/2006 Sergey ..... 343/770
2004/0155819 A1 * 8/2004 Martin et al. ..... 343/700 MS

* cited by examiner

*Primary Examiner*—Hoang V Nguyen
(74) *Attorney, Agent, or Firm*—Ditthavong Mori & Steiner, P.C.

(57) ABSTRACT

Disclosed herein is a multilayer planar array antenna. The antenna includes a waveguide, a first dielectric layer, a radiating unit, a second dielectric layer, parasitic elements, and a feeding cover unit. The waveguide is configured to transmit signals. The first dielectric layer stacked on the waveguide. The radiating unit is formed in such a way that a plurality of radiating elements and a plurality of radiating element feeding portions, which are arranged on the first dielectric layer, are formed thereon, so that a dually polarized wave is transmitted and received in a single plane. The second dielectric layer is stacked on the radiating unit. The parasitic elements are formed on the second dielectric layer to correspond to the respective radiating elements. The feeding cover unit is formed on the parasitic elements to correspond to the plurality of radiating element feeding portions.

27 Claims, 7 Drawing Sheets

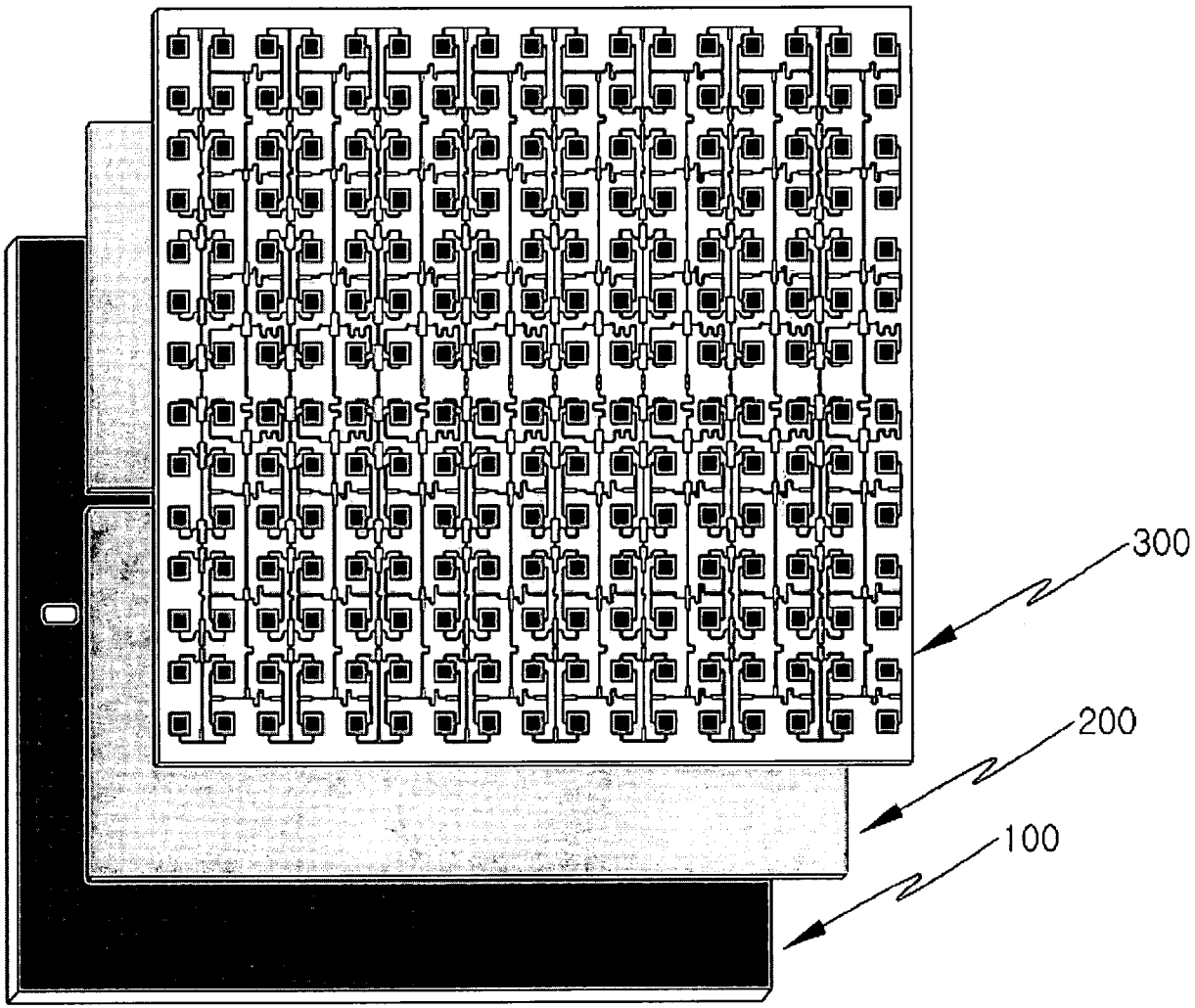
[fig. 1]

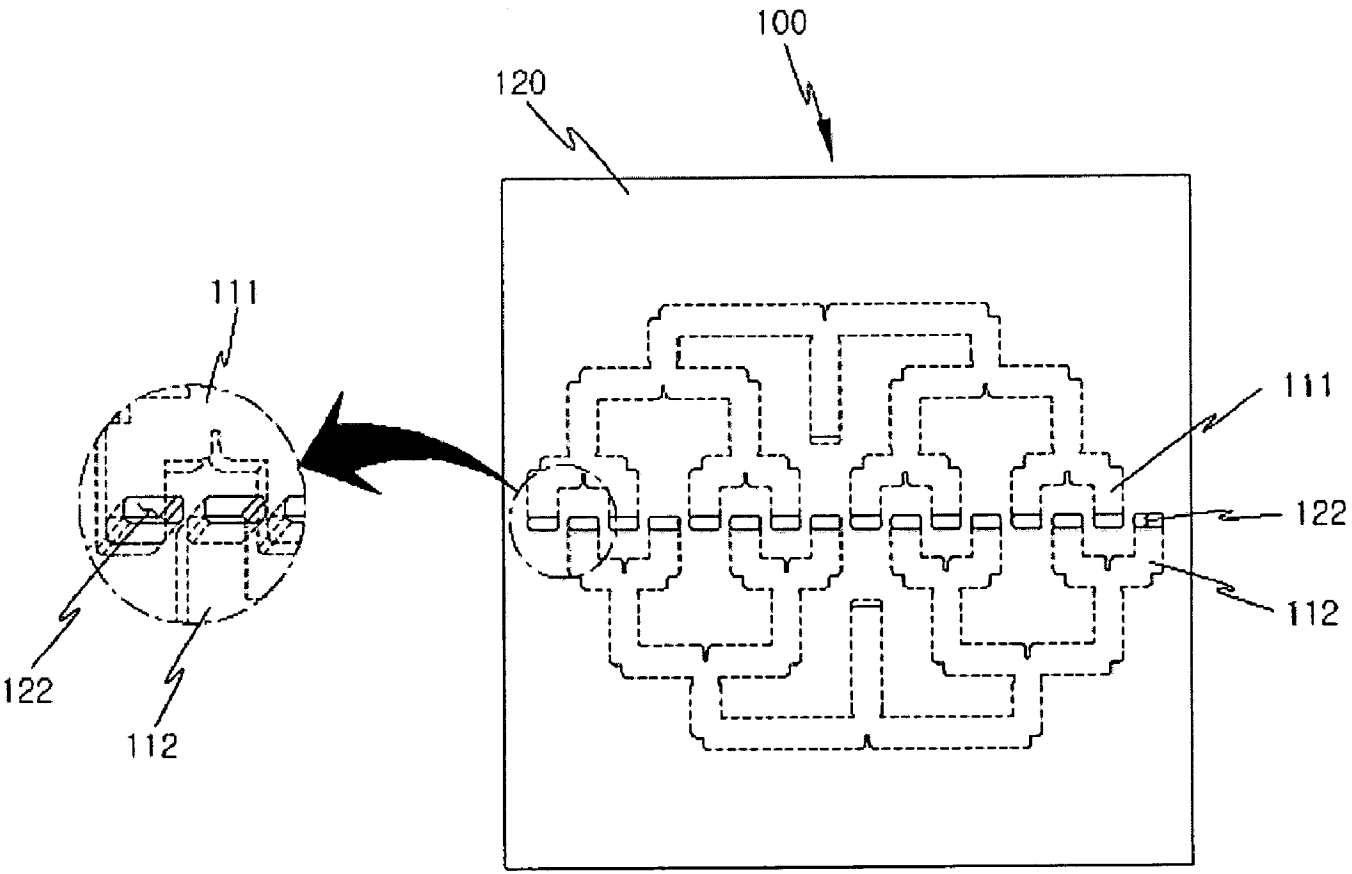
【fig. 2】

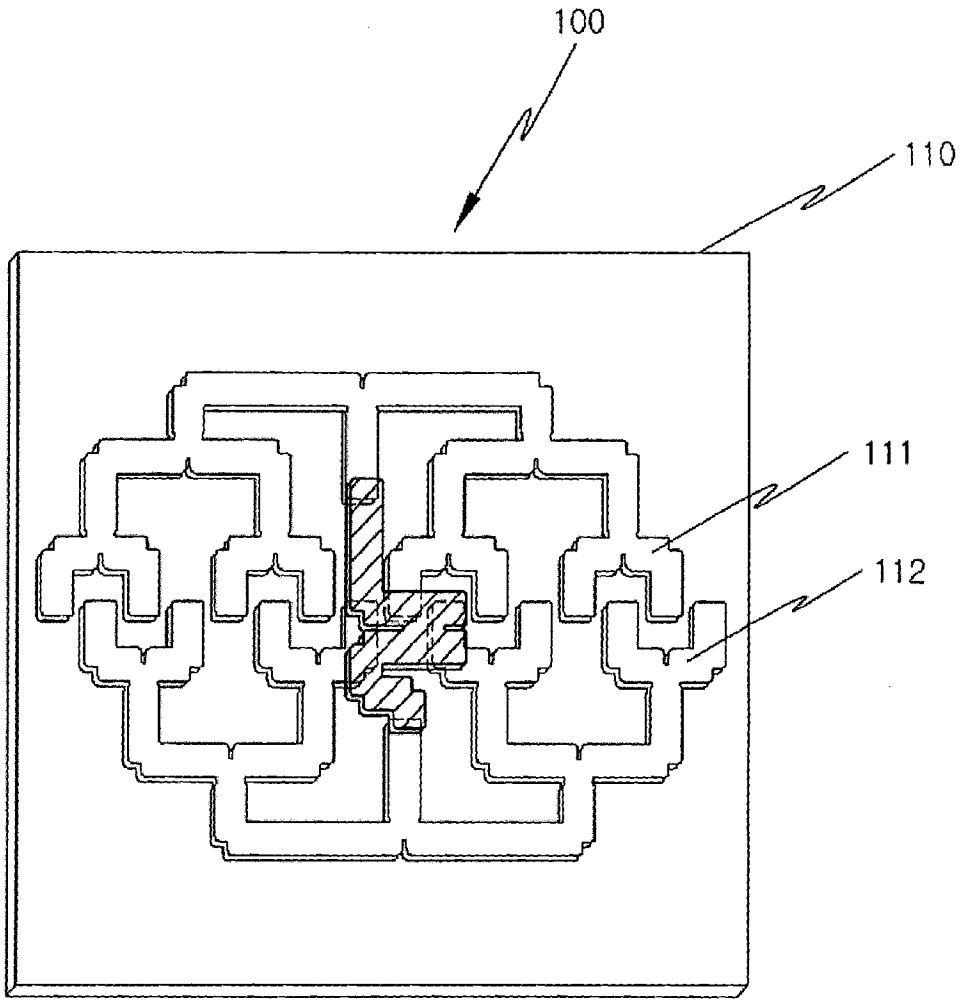
[fig. 3]

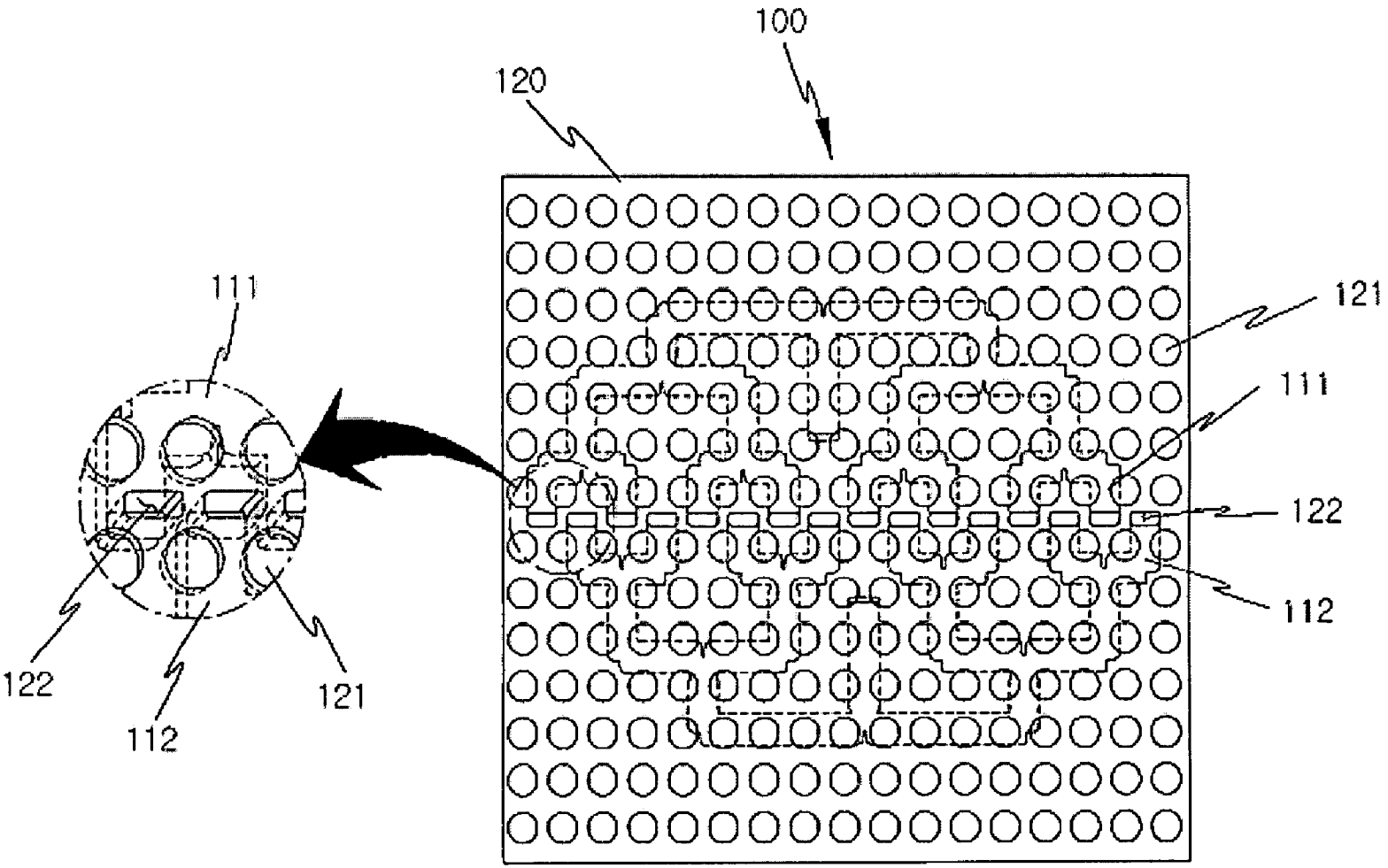
[fig. 4]

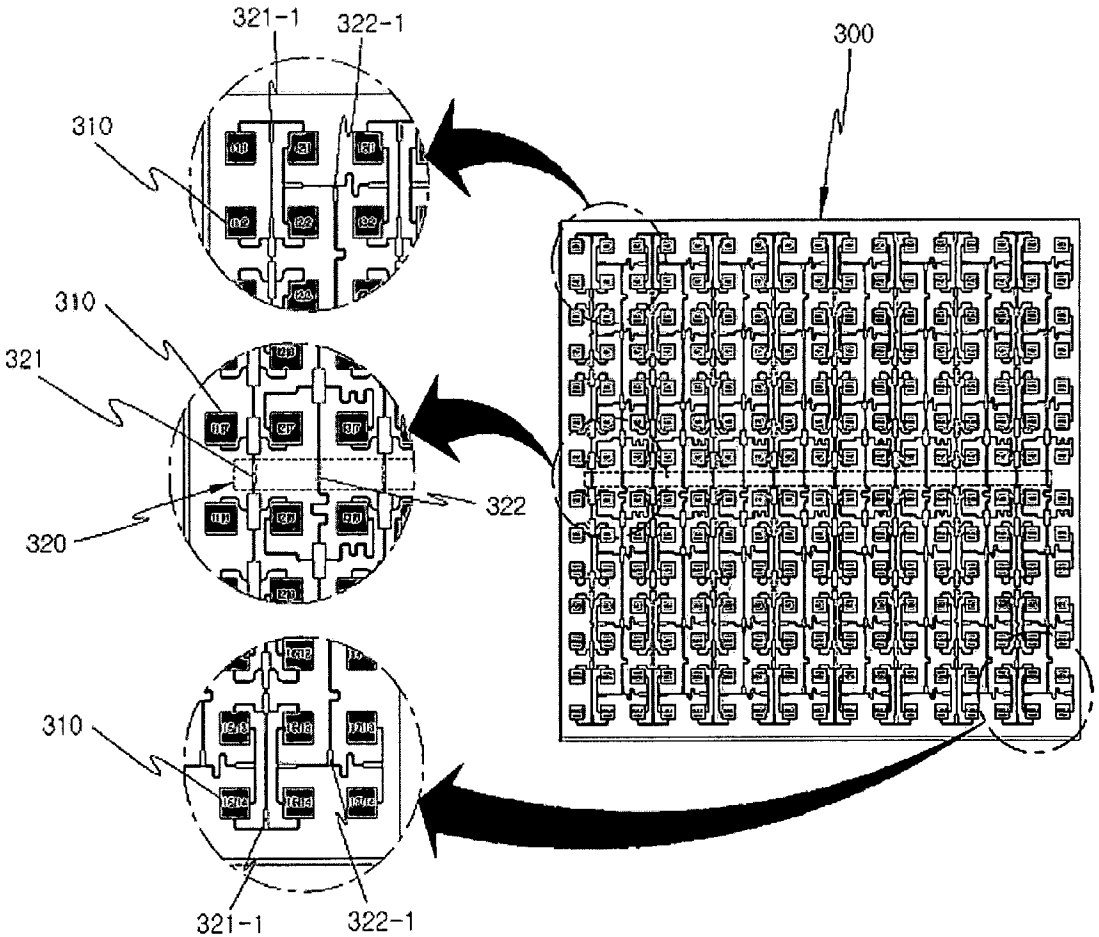
【fig. 5】

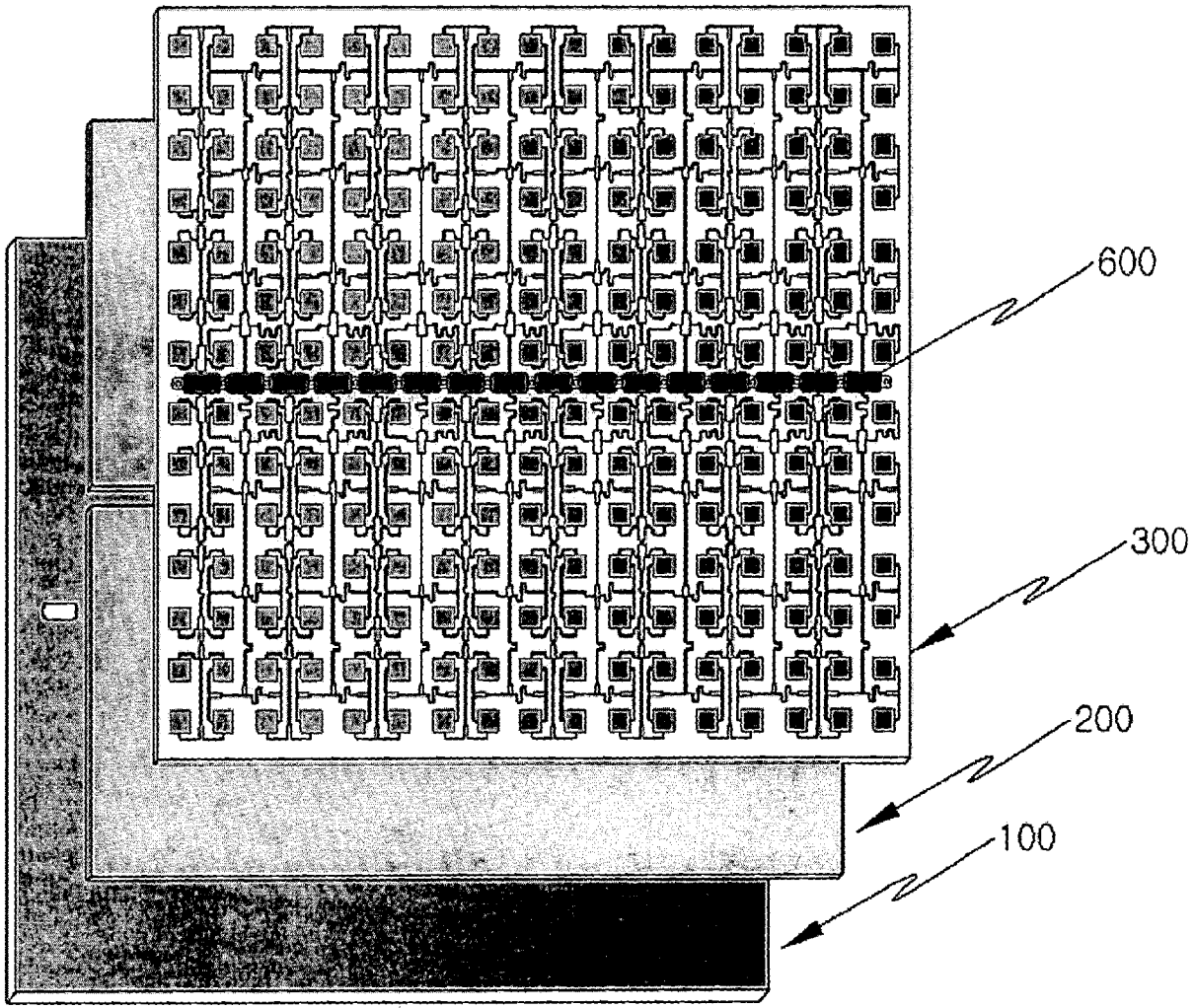
[fig. 6]

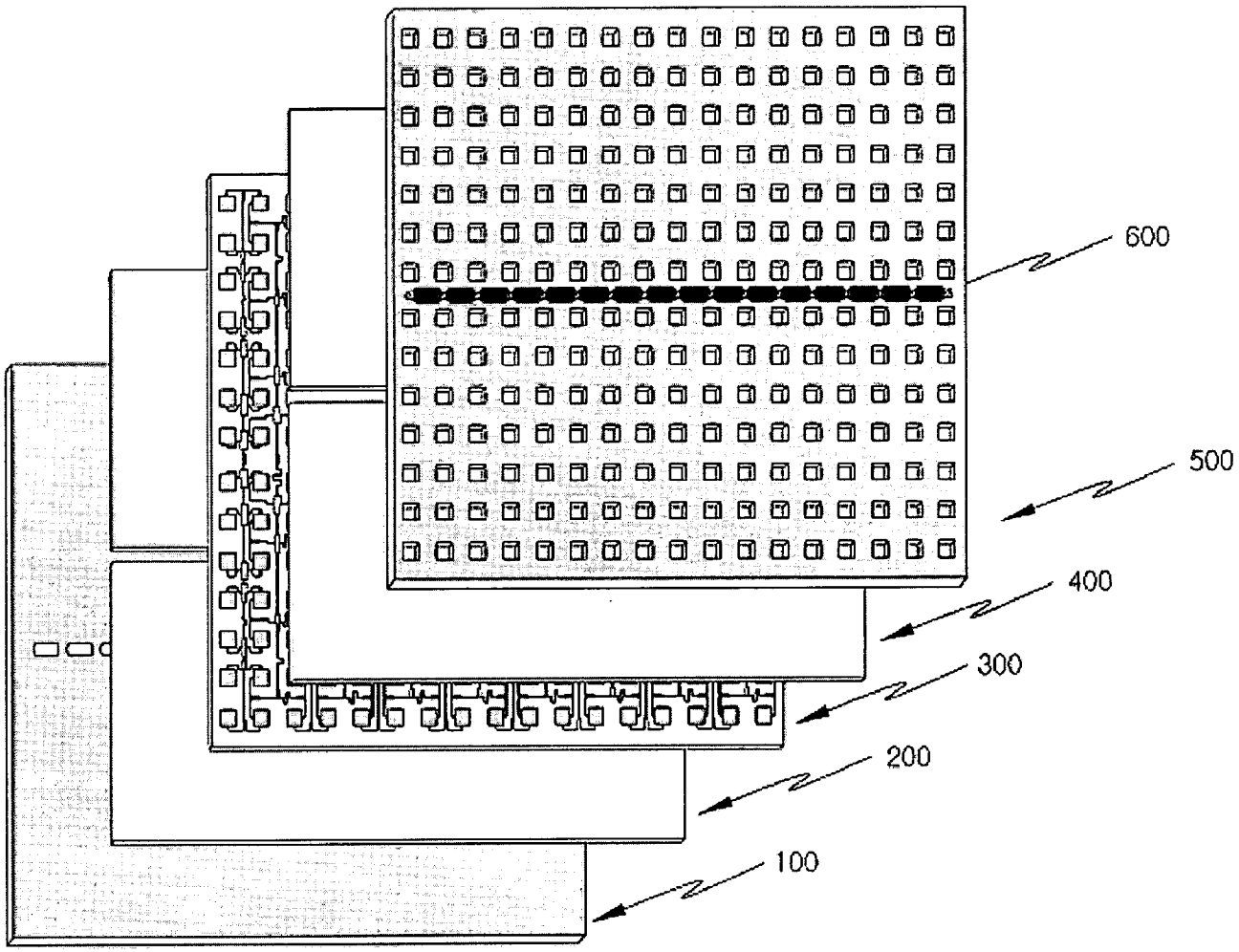
[fig. 7]

MULTILAYER PLANAR ARRAY ANTENNA

BACKGROUND OF THE INVENTION

1. Field of the Invention

The present invention relates generally to a multilayer planar array antenna and, more particularly, to a multilayer planar array antenna, which enables the reduction of the size thereof, extends the bandwidth thereof, and transmits and receives signals at high gain and high efficiency.

2. Description of the Related Art

As a technology relating to a small-sized plane antenna, including a conventional array patch antenna device, Korean Unexamined Pat. No. 2002-0015428 includes an array patch antenna element and a low-noise block down converter. The array patch antenna element includes a radiating substrate on which a plurality of slot pairs, each of which includes a first slot and a second slot that are arranged to form an angle of 180 degrees with a reflecting substrate, is formed, and on which a feeding line for supplying current to the slot pairs is formed, a lens substrate in which a plurality of lens holes is arranged, a first spacer which is disposed between the radiating substrate and a ground substrate, and a second spacer which is disposed between the radiating substrate and the lens substrate. The low-noise block down converter includes a lower casing in which a waveguide and a plurality of cavities are formed, and an upper casing which is coupled with the lower casing.

However, in the conventional technology, when a dual polarization antenna is implemented using a single polarization antenna, the dual polarization antenna is formed in a multilayer structure to differentiate signals for a feeding portion. Accordingly, problems occur in that the circuitry of the multilayer antenna is complicated, the efficiency thereof is lowered, and the size, weight and cost thereof increase.

Furthermore, the feeding of a plurality of radiating elements is performed at a single radiating element feeding portion, so that problems occur in that feeding loss from the feeding line occurs and the gain of the antenna is lowered.

SUMMARY OF THE INVENTION

Accordingly, the present invention has been made keeping in mind the above problems occurring in the prior art, and an object of the present invention is to provide a multilayer planar array antenna, in which a reflecting plate and a signal feeding portion are integrated into a single body, so that the structure thereof is simple, and dually polarized waves are generated by a single plane antenna, so that the size, weight and cost of the antenna can be reduced.

Another object of the present invention is to provide a multilayer planar array antenna, which the feeding of a plurality of radiating element feeding portions is performed in such a way as to correspond to respective signals in a one-to-one fashion, so that the efficiency of the antenna can be increased, problems, including feeding loss from a feeding line and gain loss of the antenna, can be solved, and an antenna array can be extended to a desired range when a high-gain antenna is required.

In order to accomplish the above object, the present invention provides a multilayer planar array antenna, including a waveguide configured to transmit signals; a first dielectric layer stacked on the waveguide; and a radiating unit formed in such a way that a plurality of radiating elements and a plurality of radiating element feeding portions, which are arranged on the first dielectric layer, are formed thereon, so that a dually polarized wave is transmitted and received in a single plane.

The multilayer planar array antenna further includes a reflecting plate formed in such a way that a signal feeding portion for feeding signals is formed on the lower surface of the waveguide, and feeding slots for feeding the signals from the signal feeding portion to an upper layer are formed on the upper surface of the waveguide.

The feeding of the signal feeding portion is performed using a parallel feeding method.

The feeding of the signal feeding portion is performed using a 90° hybrid feeding method of converting signals.

The reflecting plate further comprises cavities that have circular or rectangular structures and are arranged to correspond to the respective radiating elements.

The plurality of radiating element feeding portions performs the feeding of respective polarized waves to correspond to the radiating elements of the radiating units in a one-to-one fashion.

The plurality of radiating element feeding portions performs feeding so that the respective polarized waves formed by the plurality of radiating elements are fed in a reverse phase fashion.

The radiating unit forms a plurality of polarized waves depending on the shapes of the plurality of radiating elements and feeding locations.

The radiating elements of the radiating unit have a symmetrical arrangement.

In addition, the present invention provides a multilayer planar array antenna, including a waveguide configured to transmit signals; a first dielectric layer stacked on the waveguide; and a radiating unit formed in such a way that a plurality of radiating elements and a plurality of radiating element feeding portions, which are arranged on the first dielectric layer, are formed thereon, so that a dually polarized wave is transmitted and received in a single plane; and a feeding cover unit formed on the radiating unit to correspond to the radiating element feeding portions.

The multilayer planar array antenna further includes a reflecting plate formed in such a way that a signal feeding portion for feeding signals is formed on the lower surface of the waveguide, and feeding slots for feeding the signals from the signal feeding portion to an upper layer are formed on the upper surface of the waveguide.

The feeding of the signal feeding portion is performed using a parallel feeding method.

The feeding of the signal feeding portion is performed using a 90° hybrid feeding method of converting signals.

The reflecting plate further comprises cavities that have circular or rectangular structures and are arranged to correspond to the respective radiating elements.

The plurality of radiating element feeding portions performs the feeding of respective polarized waves to correspond to the radiating elements of the radiating units in a one-to-one fashion.

The plurality of radiating element feeding portions performs feeding so that the respective polarized waves formed by the plurality of radiating elements are fed in a reverse phase fashion.

The radiating unit forms a plurality of polarized waves depending on the shapes of the plurality of radiating elements and feeding locations.

In addition, the present invention provides a multilayer planar array antenna, including a waveguide configured to transmit signals; a first dielectric layer stacked on the waveguide; and a radiating unit formed in such a way that a plurality of radiating elements and a plurality of radiating element feeding portions, which are arranged on the first dielectric layer, are formed thereon, so that a dually polarized wave is transmitted and received in a single plane; a second dielectric layer stacked on the radiating unit; parasitic elements formed on the second dielectric layer to correspond to the respective radiating elements; and a feeding cover unit formed on the parasitic elements to correspond to the plurality of radiating element feeding portions.

The multilayer planar array antenna further includes a reflecting plate formed in such a way that a signal feeding portion for feeding signals is formed on the lower surface of the waveguide, and feeding slots for feeding the signals from the signal feeding portion to an upper layer are formed on the upper surface of the waveguide.

The feeding of the signal feeding portion is performed using a parallel feeding method.

The feeding of the signal feeding portion is performed using a 90° hybrid feeding method of converting signals.

The reflecting plate further comprises cavities that have circular or rectangular structures and are arranged to correspond to the respective radiating elements.

The plurality of radiating element feeding portions performs the feeding of respective polarized waves to correspond to the radiating elements of the radiating units in a one-to-one fashion.

The plurality of radiating element feeding portions performs feeding so that the respective polarized waves formed by the plurality of radiating elements are fed in a reverse phase fashion.

The radiating unit forms a plurality of polarized waves depending on the shapes of the plurality of radiating elements and feeding locations.

The parasite elements are slot shaped conductive elements.

BRIEF DESCRIPTION OF THE DRAWINGS

The above and other objects, features and advantages of the present invention will be more clearly understood from the following detailed description taken in conjunction with the accompanying drawings, in which:

FIG. 1 is a diagram showing the construction of a multilayer planar array antenna according to an embodiment of the present invention;

FIG. 2 is a diagram showing a waveguide according to FIG. 1 of the present invention in detail;

FIG. 3 is a perspective drawing showing a waveguide signal feeding portion based on a 90° hybrid method according to FIG. 1 of the present invention;

FIG. 4 is a diagram showing the waveguide, in which cavities are included, according to FIG. 1 of the present invention in detail;

FIG. 5 is a diagram showing a radiating unit according to FIG. 1 of the present invention in detail;

FIG. 6 is a diagram showing the construction of a multilayer planar array antenna according to another embodiment of the present invention; and FIG. 7 is a diagram showing the construction of a multilayer planar array antenna according to another embodiment of the present invention.

DESCRIPTION OF THE PREFERRED EMBODIMENTS

Preferred embodiments of the present invention are described in detail with reference to the accompanying drawings below.

FIG. 1 is a diagram showing the construction of a multilayer planar array antenna according to an embodiment of the present invention. The multilayer planar array antenna includes a waveguide 100 configured to transmit signals, a first dielectric layer 200 stacked on the waveguide 100, and a radiating unit 300 formed in such a way that a plurality of radiating elements 310 and a plurality of radiating element feeding portions 320, which are arranged above the first dielectric layer 100, is formed thereon, and dually polarized waves are transmitted and received in a single plane.

In more detail, as shown in FIG. 2, a signal feeding portion 110, which uses a metal plate having a high conductivity and feeds transmitted and received signals using a parallel feeding method, and a reflecting plate 120, on which feeding slots 122 for feeding the signals to the upper surface of the signal feeding portion 110 are formed, are integrated into a single body, so that the waveguide 100 can reduce loss and structural weight caused by feed lines, support scalability of the antenna if needed, and transmit high-frequency signals at high efficiency.

The signal feeding portion 110 is integrated with the reflecting plate 120 into a single body on the lower surface of the reflecting plate 120, so that structural simplicity is realized. Linearly polarized waves (vertically polarized waves and horizontally polarized waves), circularly polarized waves (left-hand circularly polarized waves and right-hand circularly polarized waves), and elliptically polarized waves (left-hand elliptically polarized waves and right-hand elliptically polarized waves) are generated by the radiating unit 300 depending on the shapes of the plurality of radiating elements 310 and feeding locations, the feeding of the dually polarized waves of each signal ((vertically polarized waves and horizontally polarized waves), or (left-hand circularly polarized waves and right-hand circularly polarized waves)) is performed at the signal feeding portion 110 using the parallel feeding method, and the signals are transmitted through the feeding slots 122.

Accordingly, the vertically and left-hand circularly polarized waves of each signal are fed through a first signal feeding line 111 using the parallel feeding method, horizontally and right-hand circularly polarized waves are fed through a second signal feeding line 112 using the parallel feeding method, and the feeding of the signals, based on the parallel feeding method, is symmetrically performed at the signal feeding portion 110.

In particular, the signal feeding portion 110 performs feeding using the parallel feeding method, in which signals (linearly polarized waves, circularly polarized waves and circularly polarized waves) are generated depending on the shapes of the plurality of radiating elements 310 and feeding locations, feeding is performed using the parallel feeding method in which the dually polarized waves ((vertically polarized waves and horizontally polarized waves), or (left-hand circularly polarized waves and right-hand circularly polarized waves)) of the signals are symmetrical with respect to the feeding lines 111 and 112 for respective polarized waves, and each of the symmetrical, dually-polarized waves is synthesized on a single feeding line.

Furthermore, the signal feeding portion 110, as shown in FIG. 3, performs conversion on each of the signals of the linearly polarized waves, the circularly polarized waves and the circularly polarized waves, which are generated depending on the shapes of the plurality of radiating elements 310 and feeding locations, using a 90° hybrid method, and outputs signals obtained through the conversion.

Accordingly, the 90° hybrid type feeding method functions to perform conversion from linearly polarized waves into circularly polarized waves or circularly polarized waves, or from circularly polarized waves to linearly polarized waves or circularly polarized waves.

The reflecting plate 120 is integrated with the signal feeding portion 110 on the upper surface of the signal feeding portion 110, so that structural simplicity can be realized, a metal plate having high conductivity can be used, and the signals of the dually polarized waves can be fed through sixteen feeding slots 122 arranged along the central portion of the reflecting plate 120.

Furthermore, the reflecting plate 120, as shown in FIG. 4, is formed in a structure in which circular or rectangular cavities 121 respectively correspond to the radiating elements 310, so that antenna radiation efficiency and frequency bandwidth can be extended, antenna gain can be increased, and variation in gain for respective frequencies can be reduced.

The first dielectric layer 200 realizes coupling between the waveguide 100 and the radiating unit 300. It is preferred that the first dielectric layer 200 be made of air or foam material and have a size of $\lambda/10$ in order to reduce the feeding loss of the signal feeding portion 110 and the radiating element feeding portions 320.

As shown in FIG. 5, 17($i$)×14($j$) radiating elements 310 are formed to be symmetrical with respect to the radiating element feeding portions 320 formed along the central portion of the radiating unit 300, and to perform feeding, so that the radiating unit 300 has a highly efficient antenna gain. The radiating element feeding portions 320 include a first radiating element feeding portion 321 for feeding eight vertically polarized waves or left-hand circularly polarized waves and a second radiating element feeding portion for feeding eight horizontally polarized waves or right-hand circularly polarized waves. The first and second radiating element feeding portions 321 and 322 are alternatively formed. In the radiating element feeding portions 320, the radiating elements 310 of two lines ((i1j1, i2j1), (i2j1, i3j1), (i3j1, i4j1) . . . (i16j1, i17j1)) are connected to sixteen radiating element feeding portions. Transmitted and received signals are synthesized with each other at twenty-eight radiating elements 310 ((i1j1, i2j1), (i1j2, i2j2), (i1j3, i2j3) . . . (i1j14, i2j14)) combined in two lines, and feeding is performed. Furthermore, the rows i2j1 to i16j1 use all of the vertically and horizontally polarized waves or left-hand and right-hand circularly polarized waves, the row i1j1 uses the vertically polarized waves or left-hand circularly polarized waves, and the row i17j1 uses the horizontally polarized waves or the right-hand circularly polarized waves.

Furthermore, the radiating unit 300 has a structure in which feeding into the plurality of radiating elements 310 is performed, so that feeding loss from the plurality of radiating element feeding portions 320 and antenna efficiency can be improved, linearly polarized waves (vertically polarized waves and horizontally polarized waves), circularly polarized waves (left-hand circularly polarized waves and right-hand circularly polarized waves), and elliptically polarized waves (left-hand elliptically polarized waves and right-hand elliptically polarized waves) can be generated depending on the feeding locations of the radiating elements 310, linearly polarized waves (vertically polarized waves and horizontally polarized waves), circularly polarized waves (left-hand circularly polarized waves and right-hand circularly polarized waves), and elliptically polarized waves (left-hand elliptically polarized waves and right-hand elliptically polarized waves) can also be generated depending on the shapes of the plurality of radiating elements 310.

Furthermore, the radiating unit 300 is formed using a Teflon, FR4, or film material. When a Ku band (12 GHz) is used, it is preferred that the radiating unit 300 be formed using a film substrate having a thickness of less than 0.02 mm.

In particular, the radiating unit 300 generates dually polarized waves in a single plane, so that structural weight and size can be greatly reduced and costs can be reduced. In order to prevent the feeding of the dually polarized waves from overlapping or crossing, the feeding of the radiating element feeding portion 320 is performed in a reverse phase fashion.

FIG. 6 is a diagram showing the construction of a multilayer planar array antenna according to another embodiment of the present invention. The multilayer planar array antenna includes a waveguide 100 configured to transmit signals, a first dielectric layer 200 stacked on the upper layer of the waveguide 100, a radiating unit 300 formed in such a way that a plurality of radiating elements 310 and a plurality of radiating element feeding portions 320, arranged on the upper layer of the first dielectric layer 100, are formed thereon and a dually polarized wave is transmitted and received in a single plane, and a feeding cover unit 600 formed on the upper surface of the radiating unit 300 to correspond to the radiating element feeding portions 320.

In more detail, the multilayer planar array antenna further includes the feeding cover unit 600 formed on the upper surface of the multilayer planar array antenna of FIG. 1, and is formed such that each of the plurality of radiating element feeding portions 320 formed on the radiating unit 300 correspond with respective feeding cover unit 600.

The feeding cover unit 600 feed back some of the signals fed upward and downward from the plurality of radiating element feeding portions 320, that is, signals fed upward, and allows the fed-back signals to be synthesized with signals fed upward and then transmitted.

The transmitted signals are transmitted and output to the signal feeding portion 110 from the feeding slots 121 formed in the reflecting plate 120 of the waveguide, so that the feeding loss from the radiating element feeding portions 320 can be reduced and the characteristics of the antenna can be kept uniform.

FIG. 7 is a diagram showing the construction of a multilayer planar array antenna according to another embodiment of the present invention. The multilayer planar array antenna includes a waveguide 100 configured to transmit signals, a first dielectric layer 200 stacked on the waveguide 100, a radiating unit 300 formed in such a way that a plurality of radiating elements 310 and a plurality of radiating element feeding portions 320, which are arranged on the upper layer of the first dielectric layer 100, are formed thereon, so that a dually polarized wave is transmitted and received in a single plane, a second dielectric layer 400 stacked on the radiating unit 300, parasitic elements 500 formed on the second dielectric layer 400 to respectively correspond to the plurality of radiating elements 310, and a feeding cover unit 600 formed on the parasitic elements 500 to correspond to the plurality of radiating element feeding portions 320.

In more detail, the multilayer planar array antenna further includes the second dielectric layer 400 stacked on the multilayer planar array antenna of FIG. 1, the parasitic elements 500 stacked on the second dielectric layer 400, and the feeding cover unit 600 formed on the parasitic elements 500.

The parasitic elements 500 are slot-shaped conductive elements, and are formed to correspond to the plurality of radiating elements 310 on a one-to-one fashion, so that the gain and efficiency of the antenna can be increased.

The feeding cover unit 600 have structures that respectively correspond to the radiating element feeding portions 320 on the parasite elements 500, so that the feeding cover unit 600 feed back some of the signals fed upward and downward from the plurality of radiating element feeding portions 320, that is, signals fed upward, and allows the fed-back signals to be synthesized with signals fed upward and then transmitted.

The transmitted signals are transmitted and output to the signal feeding portion 110 from the feeding slots 121 formed in the reflecting plate 120 of the waveguide, so that the feeding loss of the radiating element feeding portions 320 can be reduced and the characteristics of the antenna can be kept uniform.

As described above, the present invention integrates the reflecting plate with the signal feeding portion, so that it is structurally simple, and costs as well as the size and weight of the antenna can be reduced because a dually polarized wave is formed in a single plane. Furthermore, the feeding of the plurality of radiating element feeding portions is performed to correspond to signals in a one-to-one fashion, so that the efficiency of the antenna can be increased, and problems, including loss from feeding lines and loss of antenna gain, can be solved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multilayer planar array antenna, comprising:
a waveguide configured to transmit signals;
a first dielectric layer stacked on the waveguide; and
a radiating unit arranged on said first dielectric layer, said radiating unit including a plurality of radiating elements and a plurality of radiating element feeding portions formed so that a dually polarized wave is transmitted and received in a single plane, wherein said waveguide includes a signal feeding portion for feeding signals formed on the lower surface of said waveguide and a reflecting plate formed on the upper surface of said waveguide has feeding slots connected to said signal feeding portion and extending to said upper surface, wherein said signal feeding portion is connected to said plurality of radiating element feeding portions via said feeding slots.

2. The multilayer planar array antenna as set forth in claim 1, wherein feeding of the signals feeding portion is performed using a parallel feeding method.

3. The multilayer planar array antenna as set forth in claim 2, wherein the feeding of the signal feeding portion is performed using a 90° hybrid feeding method of converting signals.

4. The multilayer planar array antenna as set forth in claim 1, wherein the reflecting plate further comprises cavities that have circular or rectangular structures and are arranged to correspond to the respective radiating elements.

5. The multilayer planar array antenna as set forth in claim 1, wherein the plurality of radiating element feeding portions performs feeding of respective polarized waves to correspond to the radiating elements of the radiating units in a one-to-one fashion.

6. The multilayer planar array antenna as set forth in claim 5, wherein the plurality of radiating element feeding portions performs feeding so that the respective polarized waves formed by the plurality of radiating elements are fed in a reverse phase fashion.

7. The multilayer planar array antenna as set forth in claim 1, wherein the radiating unit forms a plurality of polarized waves depending on shapes of the plurality of radiating elements and feeding locations.

8. The multilayer planar array antenna as set forth in claim 7, wherein the radiating elements of the radiating unit have a symmetrical arrangement.

9. A multilayer planar array antenna, comprising:
a waveguide configured to transmit signals;
a first dielectric layer stacked on the waveguide; and
a radiating unit formed in such a way that a plurality of radiating elements and a plurality of radiating element feeding portions, which are arranged on the first dielectric layer, are formed thereon, so that a dually polarized wave is transmitted and received in a single plane; and
a feeding cover unit formed on the radiating unit to correspond to the radiating element feeding portions.

10. The multilayer planar array antenna as set forth in claim 9, further comprising a reflecting plate formed in such a way that a signal feeding portion for feeding signals is formed on a lower surface of the waveguide, and feeding slots for feeding the signals from the signal feeding portion to an upper layer are formed on an upper surface of the waveguide.

11. The multilayer planar array antenna as set forth in claim 10, wherein feeding of the signal feeding portion is performed using a parallel feeding method.

12. The multilayer planar array antenna as set forth in claim 11, wherein the feeding of the signal feeding portion is performed using a 90° hybrid feeding method of converting signals.

13. The multilayer planar array antenna as set forth in claim 10, wherein the reflecting plate further comprises cavities that have circular or rectangular structures and are arranged to correspond to the respective radiating elements.

14. The multilayer planar array antenna as set forth in claim 9, wherein the plurality of radiating element feeding portions performs feeding of respective polarized waves to correspond to the radiating elements of the radiating units in a one-to-one fashion.

15. The multilayer planar array antenna as set forth in claim 14, wherein the plurality of radiating element feeding portions performs feeding so that the respective polarized waves formed by the plurality of radiating elements are fed in a reverse phase fashion.

16. The multilayer planar array antenna as set forth in claim 9, wherein the radiating unit forms a plurality of polarized waves depending on shapes of the plurality of radiating elements and feeding locations.

17. The multilayer planar array antenna as set forth in claim 16, wherein the radiating elements of the radiating unit have a symmetrical arrangement.

18. A multilayer planar array antenna, comprising:
a waveguide configured to transmit signals;
a first dielectric layer stacked on the waveguide; and
a radiating unit formed in such a way that a plurality of radiating elements and a plurality of radiating element feeding portions, which are arranged on the first dielectric layer, are formed thereon, so that a dually polarized wave is transmitted and received in a single plane;
a second dielectric layer stacked on the radiating unit;
parasitic elements formed on the second dielectric layer to correspond to the respective radiating elements; and
a feeding cover unit formed on the parasitic elements to correspond to the plurality of radiating element feeding portions.

19. The multilayer planar array antenna as set forth in claim 18, further comprising a reflecting plate formed in such a way that a signal feeding portion for feeding signals is formed on a lower surface of the waveguide, and feeding slots for feeding the signals from the signal feeding portion to an upper layer are formed on an upper surface of the waveguide.

20. The multilayer planar array antenna as set forth in claim 19, wherein feeding of the signal feeding portion is performed using a parallel feeding method.

21. The multilayer planar array antenna as set forth in claim 20, wherein the feeding of the signal feeding portion is performed using a 90° hybrid feeding method of converting signals.

22. The multilayer planar array antenna as set forth in claim 19, wherein the reflecting plate further comprises cavities that have circular or rectangular structures and are arranged to correspond to the respective radiating elements.

23. The multilayer planar array antenna as set forth in claim 18, wherein the plurality of radiating element feeding portions performs feeding of respective polarized waves to correspond to the radiating elements of the radiating units in a one-to-one fashion.

24. The multilayer planar array antenna as set forth in claim 23, wherein the plurality of radiating element feeding portions performs feeding so that the respective polarized waves formed by the plurality of radiating elements are fed in a reverse phase fashion.

25. The multilayer planar array antenna as set forth in claim 18, wherein the radiating unit forms a plurality of polarized waves depending on shapes of the plurality of radiating elements and feeding locations.

26. The multilayer planar array antenna as set forth in claim 25, wherein the radiating elements of the radiating unit have a symmetrical arrangement.

27. The multilayer planar array antenna as set forth in claim 18, wherein the parasite elements are slot shaped conductive elements.

* * * * *